US010895137B2

(12) United States Patent
Juranitch et al.

(10) Patent No.: US 10,895,137 B2
(45) Date of Patent: Jan. 19, 2021

(54) METHOD, APPARATUS, REAL TIME MODELING AND CONTROL SYSTEM, FOR STEAM AND SUPER-HEAT FOR ENHANCED OIL AND GAS RECOVERY

(71) Applicant: XDI Holdings, LLC, Bedford, NH (US)

(72) Inventors: James C. Juranitch, Ft. Lauderdale, FL (US); Raymond Clifford Skinner, Coral Springs, FL (US); Alan Craig Reynolds, Novi, MI (US)

(73) Assignee: XDI Holdings, LLC, Bedford, NH (US)

( * ) Notice: Subject to any disclaimer, the term of this patent is extended or adjusted under 35 U.S.C. 154(b) by 0 days.

(21) Appl. No.: 16/074,607

(22) PCT Filed: Feb. 2, 2017

(86) PCT No.: PCT/US2017/016244
§ 371 (c)(1),
(2) Date: Aug. 1, 2018

(87) PCT Pub. No.: WO2017/136571
PCT Pub. Date: Aug. 10, 2017

(65) Prior Publication Data

US 2019/0032913 A1 Jan. 31, 2019

Related U.S. Application Data

(60) Provisional application No. 62/290,214, filed on Feb. 2, 2016, provisional application No. 62/298,453, filed on Feb. 22, 2016.

(51) Int. Cl.
*E21B 43/24* (2006.01)
*F22G 5/18* (2006.01)

(52) U.S. Cl.
CPC ..... *E21B 43/2406* (2013.01); *E21B 43/24* (2013.01); *F22G 5/18* (2013.01)

(58) Field of Classification Search
CPC ..... E21B 43/24; E21B 43/2406
See application file for complete search history.

(56) References Cited

U.S. PATENT DOCUMENTS 1,944,059 A 1/1934 Baumann
3,373,544 A 3/1968 Catlin et al.
(Continued)

FOREIGN PATENT DOCUMENTS

WO 2009129143 A1 10/2009

OTHER PUBLICATIONS

Zhou, Yet al., Thermal Hydraulic Analysis Using GIS on Application of HTR to Thermal Recovery of Heavy Oil Reservoirs. Science and Technology of Nuclear Installations 2012 (2012).

*Primary Examiner* — Kristyn A Hall
(74) *Attorney, Agent, or Firm* — Dykema Gossett PLLC

(57) ABSTRACT

Various embodiments of the present disclosure include a system for reducing an operating expense and a steam oil ratio (SOR) of at least one of an enhanced oil recovery system and a gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein the plurality of super-heat levels are implemented per each one of the plurality of downstream sections of the at least one of the enhanced oil recovery system and gas recovery system to reduce the SOR.

21 Claims, 4 Drawing Sheets

(56) References Cited

U.S. PATENT DOCUMENTS

| | | | |
|---|---|---|---|
| 4,641,710 | A | 2/1987 | Klinger |
| 7,367,399 | B2 | 5/2008 | Steele et al. |
| 8,770,288 | B2 | 7/2014 | Kaminsky |
| 2005/0166961 | A1 | 8/2005 | Means et al. |
| 2010/0224370 | A1 | 9/2010 | Donnelly et al. |
| 2013/0020078 | A1 | 1/2013 | Vasudevan |
| 2013/0068458 | A1 | 3/2013 | Macadam et al. |
| 2015/0345271 | A1 | 12/2015 | Cochrane et al. |

METHOD, APPARATUS, REAL TIME MODELING AND CONTROL SYSTEM, FOR STEAM AND SUPER-HEAT FOR ENHANCED OIL AND GAS RECOVERY

CROSS-REFERENCE TO RELATED APPLICATION

This application claims priority to U.S. provisional patent application No. 62/290,214 (the '214 application) titled "METHOD, APPARATUS, REAL TIME MODELING AND CONTROL SYSTEM, FOR STEAM AND SUPER HEAT FOR ENHANCED OIL AND GAS RECOVERY," filed 2 Feb. 2016. This application claims priority to U.S. provisional patent application No. 62/298,453 (the '453 application) titled "METHOD, APPARATUS, REAL TIME MODELING AND CONTROL SYSTEM, FOR STEAM AND STEAM WITH SUPER-HEAT FOR ENHANCED OIL AND GAS RECOVERY," filed 22 Feb. 2016. Both the '214 application and '453 application are hereby incorporated by reference as though fully set forth herein.

FIELD

Embodiments of the present disclosure generally relate to a method, apparatus, real time modeling and control system, for steam and steam with super-heat and steam with super-heat that includes heavy hydrocarbon viscosity reducers selected from the group consisting of light hydrocarbons, solvents, and surfactants for enhanced oil and gas recovery. Super-heat is also utilized as a method to efficiently extend the reach of existing steam generators in a chamber and to remote well pads.

BACKGROUND

Steam boilers can be used in the oil and gas recovery world. Examples of steam boilers used in the oil and gas recovery world can include Once Through Steam Generators (OTSG), Drum Boilers, and/or Direct Steam Generators (DSG). These types of steam boilers can be used to generate saturated steam for enhanced oil and gas recovery. Solvent or surfactant assisted saturated steam has been utilized in relation to enhanced oil recovery, however, this practice has been confined to saturated steam applications.

SUMMARY

Various embodiments of the present disclosure include a system for reducing an operating expense and a steam oil ratio (SOR) of at least one of an enhanced oil recovery system and a gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein the plurality of super-heat levels are implemented per each one of the plurality of downstream sections of the at least one of the enhanced oil recovery system and gas recovery system to reduce the SOR.

Various embodiments of the present disclosure include a system for reducing an operating expense and SOR of at least one of an enhanced oil recovery system and a gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein a real time control system controls the plurality of super-heat levels per section of the at least one of the enhanced oil recovery system and gas recovery system.

Various embodiments of the present disclosure include a system for reducing an operating expense and SOR of at least one of an enhanced oil recovery system and gas recovery system. The system can include a boiler configured to produce steam. The system can include a super-heater in fluid communication with the boiler, the super-heater configured to generate a plurality of super-heat levels in a plurality of sections of the at least one of the enhanced oil recovery system and the gas recovery system downstream of the super-heater, wherein a real time control system controls the plurality of super-heat levels per section of the at least one of the enhanced oil recovery system and gas recovery system using a temperature feedback as a method to invoke super-heated steam conditions.

Various embodiments of the present disclosure include a system for reducing an operating expense and SOR of at least one of an enhanced oil recovery system and gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein a real time control system controls the plurality of super-heat levels per section of the at least one of the enhanced oil recovery system and the gas recovery system using a temperature feedback as a method to invoke super-heated steam conditions at both surface and sub-surface locations of piping included in the at least one of the oil recovery system and the gas recovery system.

Various embodiments of the present disclosure can include a system for reducing an operating expense and SOR of at least one of an enhanced oil recovery system and gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein a real time control system controls the plurality of super-heat levels per section of the at least one of the enhanced oil recovery system and the gas recovery system using a temperature feedback and at least one of discontinuous and continuous control tables to invoke super-heated steam conditions.

Various embodiments of the present disclosure can include a system for reducing an operating expense and SOR of at least one of an enhanced oil recovery system and gas recovery system. The system can include a boiler configured to produce steam. The system can further include a super-heater in fluid communication with the boiler, the super-heater configured to generate a plurality of super-heat levels in a plurality of sections of the at least one of the enhanced oil recovery system and the gas recovery system downstream of the super-heater, wherein a real time control system controls the plurality of super-heat levels per section of the at least one of the enhanced oil recovery system and the gas recovery system using a temperature feedback and at least one of discontinuous and continuous control tables and a supervisory loop to invoke super-heated steam conditions.

Various embodiments of the present disclosure can include A system for reducing an operating expense and SOR of at least one of an enhanced oil recovery system and gas recovery system. The system can include at least one boiler in fluid communication with a plurality of wells included in a plurality of sections of the at least one of the enhanced oil recovery system and gas recovery system, wherein the boiler is configured to produce steam, and wherein a real time control system controls steam flow levels to each one of the plurality of wells of the at least one of the enhanced oil recovery system and gas recovery system with or without super-heat.

Various embodiments of the present disclosure can include A system for reducing an operating expense and SOR of at least one of an enhanced oil recovery system and gas recovery system. The system can include at least one boiler in fluid communication with a plurality of wells included in a plurality of sections of the at least one of the enhanced oil recovery system and gas recovery system, wherein the boiler is configured to produce steam, and wherein a real time control system controls steam flow levels to each one of the plurality of wells of the at least one of the enhanced oil recovery system and gas recovery system using a temperature feedback as a method to invoke steam flow conditions with or without super-heat.

Various embodiments of the present disclosure can include a system for reducing an operating expense and SOR of at least one of an enhanced oil recovery system and gas recovery system. The system can include at least one boiler in fluid communication with a plurality of wells included in a plurality of sections of the at least one of the enhanced oil recovery system and gas recovery system, wherein the boiler is configured to produce steam, and wherein a real time control system controls steam flow levels to each one of the plurality of wells of the at least one of the enhanced oil recovery system and gas recovery system using a temperature feedback and at least one of discontinuous and continuous control tables to invoke steam flow conditions.

Various embodiments of the present disclosure can include a system for reducing an operating expense and SOR of at least one of an enhanced oil recovery system and gas recovery system. The system can include at least one boiler in fluid communication with a plurality of wells included in a plurality of sections of the at least one of the enhanced oil recovery system and gas recovery system, wherein the boiler is configured to produce steam, and wherein a real time control system controls steam flow levels with or without super-heat to each one of the plurality of wells of the at least one of the enhanced oil recovery system and gas recovery system using a temperature feedback, at least one of discontinuous and continuous control tables, and supervisory loops to invoke optimum steam flow conditions.

DETAILED DESCRIPTION

Figure 1:
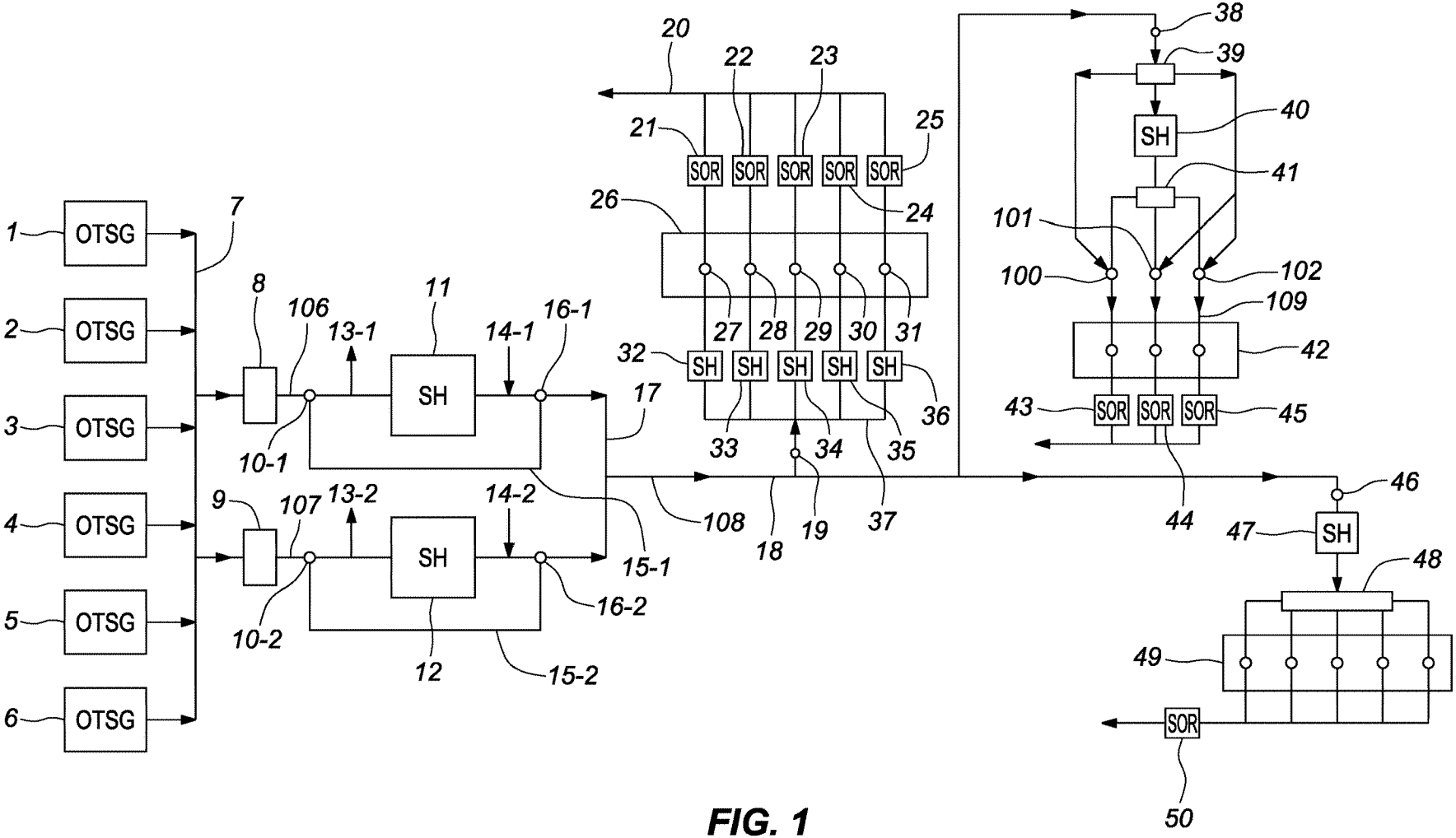
FIG. 1 depicts a system and apparatus for enhanced oil and gas recovery with super focused heat that employs Once Through Steam Generator (OTSG) boilers, in accordance with embodiments of the present disclosure.

Embodiments of the present disclosure advance the implementation of steam injection and steam injection with super-heaters and steam with super-heat and heavy hydrocarbon viscosity reducers, such as those selected from the group consisting of light hydrocarbons, solvents, and surfactants for use in oil and gas recovery and provide cost effective super-heater implementation for an enhanced oil recovery site. Embodiments of the present disclosure can advance the modeling and real time control of steam injection for both steam circulation, Steam Assisted Gravity Drain (SAGD), bitumen production, and/or Cyclic Steam Stimulation (CSS), and Steam Flood processes. Embodiments of the present disclosure include a system, method, and apparatus comprising at least a boiler. Some embodiments can include a boiler and a method to generate Super-Heat which may be embodied directly in a DSG or through the addition of at least a super-heater or more than one super-heater, in one or more locations in an enhanced oil recovery system such as a Steam Assisted Gravity Drain (SAGD) site, CSS site, Steam Flood, and/or other types of oil and gas recovery. The super-heater can be in series with a boiler which can be a OTSG, Drum Boiler or any other style of steam generator. Some embodiments of the present disclosure include an apparatus, real time modeling and/or real time control system for steam and steam super-heat for enhanced oil and gas recovery. Some embodiments of the present disclosure include an automated real time characterization of a control model and system and its functions for an enhanced oil or gas recovery system and/or the implementation of an optimized super-heat process layout, self-cleaning super-heater system. Some embodiments of the present disclosure include the development and implementation of cost effective and reliable feedback metrics and an automatic system for the control and/or modeling and/or scheduling of an optimized amount of super-heat and/or steam to minimize the operational costs required to produce oil and/or minimize the required steam and energy required to produce a barrel of oil. Some embodiments of the present disclosure can include the addition of heavy hydrocarbon viscosity reducers to the super-heated steam and/or the saturated steam before it becomes super-heated. For example, some embodiments of the present disclosure can include the addition of heavy hydrocarbon viscosity reducers selected from the group consisting of light hydrocarbons, solvents, and surfactants to the super-heated steam and/or the saturated steam before it becomes super-heated. An ideal embodiment can be implemented on a per well level invoking individual well optimization.

In enhanced oil and gas recovery, steam can be utilized many times. This could include Steam Assisted Gravity Drain (SAGD), CSS, Steam Flood, and/or other types of oil and gas recovery. A steam boiler can be utilized to generate saturated steam, which can then be directed to melt out or mobilize the oil and gas in underground deposits. Typically, a Once Through Steam Generator (OTSG) or a Drum Boiler can be used to generate the steam, which can be saturated steam. The steam can be pumped through a series of conduits or pipes eventually traveling underground to the desired heavy oil or other desired deposit. The steam in most cases can be generated as saturated steam product at the outlet of the boiler. The saturated steam can be directed through the balance of the oil or gas recovery system. Much heat and steam energy can be lost in the process without the benefit of producing a product, such as bitumen or heavy oil. The oil and gas industry can keep score on a site's oil recovery efficiency with a Steam Oil Ratio (SOR). The SOR logs the metric of how many barrels of water in the form of steam are required to net a barrel of oil. SORs can range from approximately 2 to 6. All sites and operators desire the lowest operating SOR possible. The SOR at a site directly relates to the cost of oil recovery.

Steam in its many forms has different heat transfer characteristics/coefficients. These heat transfer coefficients then directly relate to the amount of heat energy transferred from the steam as it passes through a system or pipe. The amount of heat energy transferred can vary dramatically. For example, at a given steam pressure, temperature, and multiphase condition, the heat energy transferred through a pipe can range from a factor of 1 for super-heated steam to an approximate factor of 10 for saturated steam to a factor of approximately 4 for condensate. Embodiments of the present disclosure can use this characteristic of steam to minimize the amount of steam energy that is being wasted in existing enhanced oil or gas recovery systems. Embodiments of the present disclosure can utilize improved process controls, real time modeling and real time control systems (implemented, for example, in the software or firmware of a control system) to schedule the super-heated steam, light hydrocarbon, solvent and/or surfactant enhanced steam, and/or solvent and/or surfactant enhanced super-heated steam.

Embodiments of the present disclosure can improve the efficiency of an enhanced oil or gas recovery site. As an example, embodiments of the present disclosure can be employed and/or described in relation to Steam Circulation and/or Steam Assisted Gravity Drain (SAGD). Embodiments of the present disclosure can be used to optimize any steam system or enhanced oil or gas recovery process.

Some embodiments of the present disclosure can include the addition of viscosity reducers. For example, some embodiments of the present disclosure can include the addition of viscosity reducers selected from the group consisting of solvents, light hydrocarbons (e.g., methane, ethane, propane, butane, pentane, and/or hexane) and surfactants added to steam with super-heat, which can provide for a superior enhanced oil recovery process. However, embodiments of the present disclosure are not limited to the addition of viscosity reducers selected from the group consisting of light hydrocarbons, solvents, and surfactants and in some embodiments other types of viscosity reducers can be used. In some embodiments, the additives can be formulated to condense and/or activate slightly above and/or slightly below (e.g., within a defined range of) the saturated steam temperature, which can increase their effectiveness in the enhanced oil recovery process. In some embodiments, the additives can be formulated to condense and/or activate in a range from 5 degrees Celsius to −5 degrees Celsius, from 20 degrees Celsius to −20 degrees Celsius, and/or from 50 degrees Celsius to −50 degrees Celsius. In some embodiments, the additives can be formulated to condense and/or activate in a range from 10 to −25 degrees Celsius. The super-heat control process described herein can optimize the use of heavy hydrocarbon viscosity reducers selected from the group consisting of light hydrocarbons, solvents, and surfactants since they are not reduced in their effectiveness as they are lost to condensate. This is of critical importance because the efficient use of heavy hydrocarbon viscosity reducers, such as those selected from the group consisting of light hydrocarbons, solvents, and surfactants is required due to the cost associated with the heavy hydrocarbon viscosity reducers. The lack of economic viability (e.g., cost associated with solvent and surfactant based products) has held solvent and surfactant based products back from being deployed in large scale and/or common enhanced oil production.

Unconventional oil has always been under economic pressure to produce in a cost efficient manner. The water treatment plants and conventional boilers are a large portion of the producers cost. The surface piping length is limited in length due to the physics of heat loss in an insulated pipe. Super-heat implementation can be used to extend the surface and vertical piping run of an existing water treatment plant and boiler facility to utilize these expensive assets more effectively.

FIG. 1 depicts a system and apparatus for enhanced oil and gas recovery with super focused heat that employs OTSG boilers, in accordance with embodiments of the present disclosure. As depicted in FIG. 1, OTSG boilers 1 through 6 (e.g., OTSG boilers 1, 2, 3, 4, 5, and/or 6) direct saturated steam through post blow down, and separation (not shown) to manifold 7. Although six OTSG boilers are depicted, greater than or fewer than six OTSG boilers can be used. The saturated steam can be sent through one or more additional optional separators 8 and 9 to attain greater than 99.9% condensate removal. Some embodiments of the present disclosure can include the addition of heavy hydrocarbon viscosity reducers selected from the group consisting of light hydrocarbons, solvents, and surfactants before the super-heater via pre super-heater surfactant conduits 106 and 107 in FIG. 1. The addition of these additives to the steam for enhanced performance is described hereinafter as Additive Enhanced Steam (AES). The purified steam travels through upstream three way valves 10-1, 10-2 to the super-heaters 11, 12 and/or through bypass conduits 15-1, 15-2. In some embodiments, other metering processes can be used alternatively or in addition to three way valves. For example, two one way valves can be used to provide purified steam to each of the super-heaters 11 and 12 and/or out downstream three way valves 16-1, 16-2 to manifold 17 and/or two one way valves can be used to provide purified steam to bypass conduits 15-1, 15-2. Hereinafter, upstream three way valves 10-1, 10-2 are collectively referred to as upstream three way valves 10 and downstream three way valves 16-1, 16-2 are collectively referred to as downstream three way valves 16. In some embodiments, heavy hydrocarbon viscosity reducers selected from the group consisting of light hydrocarbons, solvents, and surfactants can be added after the super-heater via post super-heater surfactant conduit 108 to create AES.

Three way valves 10 and 16 can be automatically cycled and can bypass the steam from manifold 7 around super-heaters 11 and/or 12 via bypass conduits 15-1, 15-2 while wash waste conduits 13-1, 13-2 and wash feed conduits 14-1, 14-2 are used to backwash and clean super-heaters 11 and 12 in an automated fashion. Washing regimes can be instigated by pre-arranged schedules or by automated control based on parameters such as super-heater surface tube temperatures or super-heater efficiencies derived from delta temperatures across the super-heater. Although two super-heaters are depicted and discussed by example, one or more super-heaters could be used at the outlet of manifold 7.

Super-heaters 11 and 12, as shown in FIG. 1, will effectively extend the useful length of conduit 18 to direct high quality steam to remote well pads. Additional super-heaters in a similar configuration can be applied to conduit 18 further downstream to again extend the range of produced high quality steam to access further remote well pads from existing water treatment plants and boilers. This can allow for more efficient use of existing capital investments for the producing companies. Steam quality can be defined as a proportion of saturated steam in a saturated condensate (e.g., liquid) and steam (e.g., vapor) mixture. High quality steam can be defined as steam having a proportion of saturated steam in the mixture in a range from 100 percent to 98 percent.

Although super-heaters are depicted in FIG. 1, in some embodiments, the system can operate without super-heaters and can employ only boilers. In some embodiments, at least one boiler can be in fluid communication with a plurality of wells included in a plurality of sections of at least one an enhanced oil recovery system and gas recovery system. In some embodiments, a section can be a complete surface steam line pipe system; a portion of a surface steam line pipe; a section of steam line pipe ending at a well pad; a pipe section ending at a well head; a pipe section ending at the heel of a chamber; and/or a section of pipe ending at a portion of a chamber.

In some embodiments, the super-heaters can be in fluid communication with the boiler. The super-heaters can be configured to generate a plurality of super-heat levels in a plurality of sections of the at least one of the enhanced oil recovery system and the gas recovery system downstream of the super-heater. The plurality of super-heat levels are implemented per each one of the plurality of downstream sections of the at least one of the enhanced oil recovery system and gas recovery system to reduce the SOR.

Figure 4:
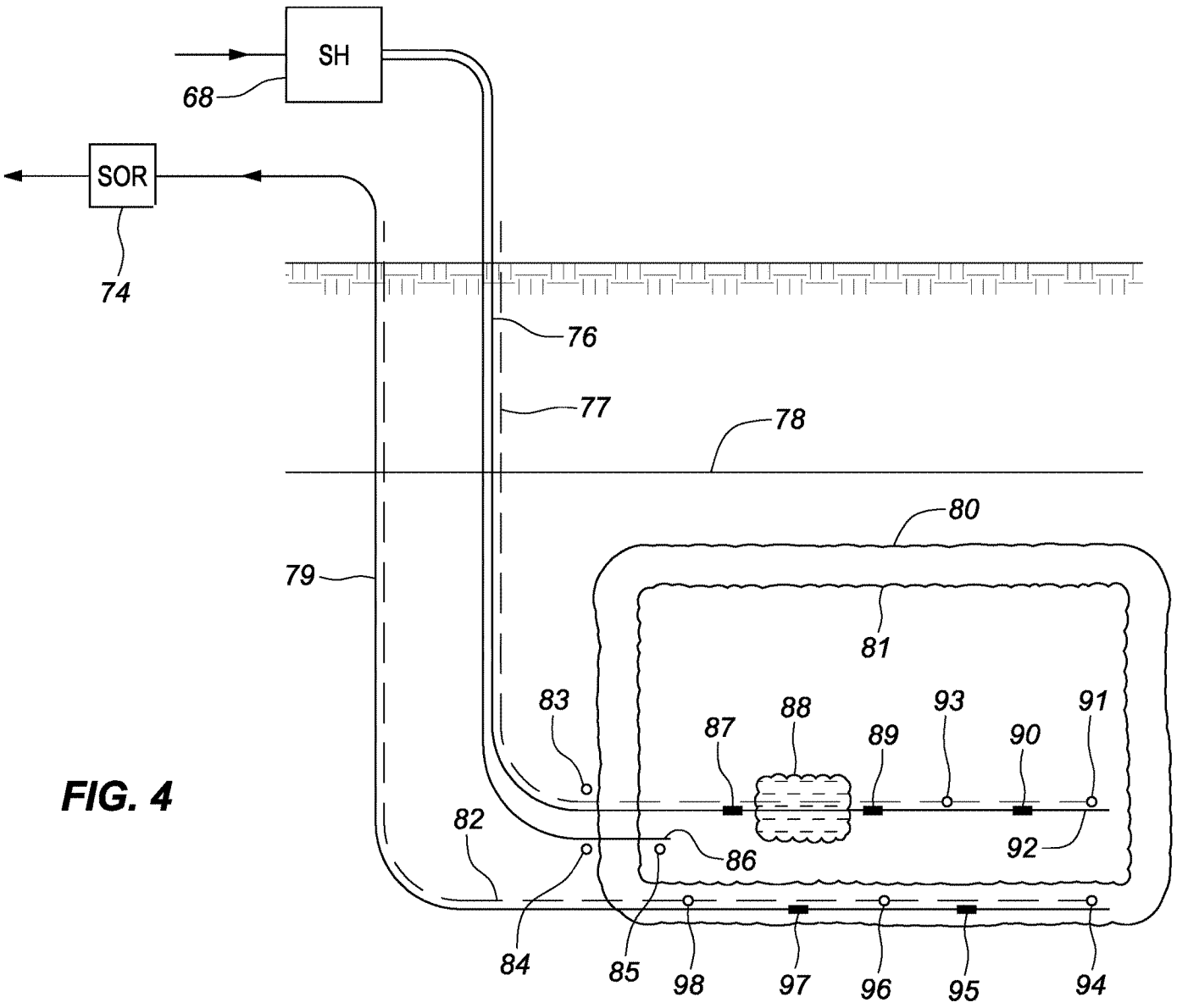
FIG. 4 depicts improved process controls, real time modeling, and real time control systems for site sub surface piping, in accordance with embodiments of the present disclosure.

Embodiments of the present disclosure can include a first temperature measurement device 19, second temperature measurement device 38, and third temperature measurement device 46, which can be thermocouples, thermistors, and/or other temperature measurement devices disposed at an entrance to, for example three different well pads. For instance, the temperature measurement devices can be configured to measure a temperature of steam flowing through steam conduit 18, as it reaches the three different well pads. These temperature measurement devices 19, 38, 46 (e.g., feedbacks) are used as a cost effective and efficient way to control super-heat in the above ground piping. Closed loop real time control and modeling of the complete enhanced oil or gas recovery system provides a significant part of the value associated with implementing the super-heat system associated with embodiments of the present disclosure. The goal of the super-heat system is to not allow condensate to form until the steam is in the presence of bitumen, which is desired to be heated and melted out in the first chamber 81, depicted in FIG. 4. With further reference to FIG. 4, some embodiments of the present disclosure include methods to optimize steam injection into first chamber 81 without the use of super-heat. Examples of this can include the control of steam flow using a statistically derived model that employs fiber optic temperature feedback 82 to automatically control an optimized temperature difference or subcool between the injected steam line 76 on the Toe injection pipe 76, 92 and Heel injection pipe 86 versus producer conduit 79 temperature sensors.

Figure 3:
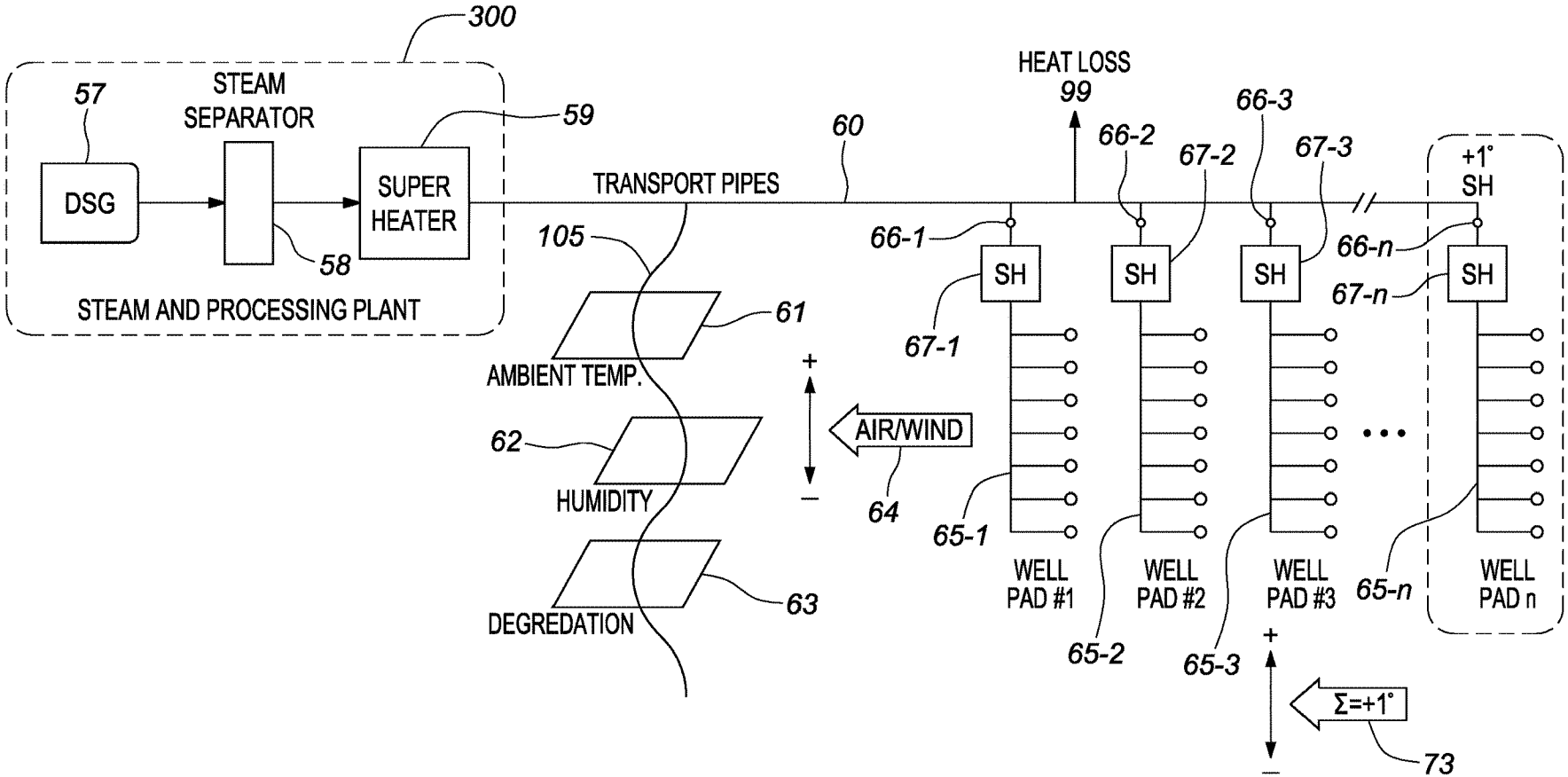
FIG. 3 depicts improved process controls, real time modeling, and real time control systems for site surface piping, in accordance with embodiments of the present disclosure.

FIG. 3 depicts improved process controls, real time modeling, and real time control systems for site surface piping, in accordance with embodiments of the present disclosure. An example of a preferred embodiment of real time modeling and real time control is shown in FIG. 3. A steam generation and super-heat system as described and detailed herein is shown as system 300, which can employ a DSG 57, steam separator 58, and/or super-heater 59. The system 300 can be in fluid communication with a steam conduit 60, which can provide steam to well pad super-heaters 67-1, 67-2, 67-3, **67-*n* and ultimately well pads 65-1, 65-2, 65-3, 65-*n*. The well pad super-heaters 67-1, 67-2, 67-3, 67-*n* can be similar to or the same as well pad super-heaters discussed in relation to FIG. 1. A temperature measurement device 66-1, 66-2, 66-3, 66-*n* can be associated with each one of the well pads 65-1, 65-2, 65-3, 65-*n*, respectively. The temperature measurement devices 66-1, 66-2, 66-3, 66-*n* can be similar to or the same as, for example, temperature measurement devices 19, 38, 46 as discussed in relation to FIG. 1**.

The goal of the control system and real time modeling system for the above surface piping can be to deliver the optimum amount of super-heated steam to the well pad super-heaters 67-1, 67-2, 67-3, **67-*n*; or in the case of a non super-heated system, the optimum amount of saturated steam to the well pads 65-1, 65-2, 65-3, 65-*n* and first chamber 81. If AES is introduced per well and controlled per well it is shown as an example as being introduced at location 109 in FIG. 1**.

The optimum amount of super-heat can be defined many different ways for different real time modeling systems. In a preferred embodiment, the optimum amount of super-heat can be defined as the minimum amount of reliably measured energy content above saturated steam conditions (e.g., within a defined range of saturated steam conditions), such as an additional 1 degree (F or C) above saturated steam conditions at the farthest distance from the super-heater 59 that the process steam must travel to a well pad 65-1, 65-2, 65-3, **65-*n*. For example, the farthest distance from the super-heater 59 that the process steam must travel to the well pad can be defined as the piping section at the entrance of well pad super-heater 67-*n* shown in FIG. 3 and/or temperature measurement device 66-*n*** (e.g., control feedback device).

Any of super-heaters 67-1, 67-2, 67-3, **67-*n* could be eliminated for the purpose of cost reduction and could be replaced by a greater amount of super-heat scheduled from super-heater 59, depicted in FIG. 3. However, as a result, the resolution of control of the amount of super-heat delivered to the appropriate well's chamber can be reduced as a result of eliminating one or more of super-heaters 67-1, 67-2, 67-3, 67-*n***.

In order to control the amount of steam and super-heat or AES directed to each well pad and/or well in an optimized fashion, a real time modeling and real time closed loop control system can be utilized. The functions affecting the optimum control of super-heat can be both discontinuous and continuous in nature and therefore can be better controlled using a discontinuous control strategy such as the control tables shown as 61, 62, and 63 in FIG. 3 and/or a continuous control strategy or "outside" loop (e.g., supervisory loop) as depicted by wind control gain input 64 and/or error summation function 73 in FIG. 3. Some embodiments of the present disclosure can include non-transitory computer executable instructions, which can be executed by a processing device (e.g., computer) to perform various functions, as discussed herein. For example, embodiments of the present disclosure can include instructions executable to implement a discontinuous and/or continuous control strategy. As a further example, the control tables can include non-transitory computer executable instructions, which can be executed by a processing device (e.g., computer) to perform a particular function, as discussed herein.

In a preferred real time control and real time modeling embodiment, the minimum amount of super-heat required to offset "agent" or heat loss 99 to cause a temperature of the steam at a particular point (e.g., at a point defined by the temperature measurement device 66-*n*) to be affected a minimum amount above the saturated steam's energy level is described herein.

A statistically based iterative computer modeling program, such as MathWorks, MatLab, and/or Simulink, can be employed to populate ambient temperature control table 61 (e.g., control component) with multiplier values or "gains" above and/or below (e.g., within a defined range of) a nominal amount of super-heat required to fulfill the constraints enumerated in ambient temperature control table 61, for the purpose of offsetting the effects of system heat loss due to ambient temperature change. In some embodiments, the real time modeling program such as MathWorks, MatLab, and/or Simulink can empirically derive the appropriate gain factors to populate a reasonable amount of values associated with measured ambient conditions versus measured super-heat responses at temperature measurement device 66-*n* in ambient temperature control table 61. Any super-heat and/or steam quality feedback at the farthest well pad from the super-heater 59 could be used.

As discussed herein, one or more super-heaters can optionally be employed in series or parallel in the system. The balance of desired gains to populate ambient temperature control table 61 could be mathematically derived by the statistically based math program. A greater real time control accuracy can be obtained in response to an increase in the amount of (e.g., number of) empirical values that are measured. The balance of desired control "dimensions" and/or control tables (e.g., control tables 62, 63) are populated with their appropriate gains in a process analogous to that described in relation to the description of ambient temperature control table 61; ideally being completed in descending order of control effect. In other words, the most relevant or powerful gain factor is mapped first and the less relevant or less powerful gain factors are mapped as tables as a consequence of the invoked previous table's control authority (e.g., the control tables can be populated in descending order based on a potential by which their gain factors affect and/or reduce a temperature of and/or energy associated with the steam). For example, ambient temperature control table 61 can be populated first, followed by humidity control table 62, followed by degradation control table 63. Ideally, to accomplish this task, humidity control table 62, which by example represents ambient humidity, is populated with gain factors that are again both empirically measured and mathematically derived while ambient temperature is ideally in a relatively constant state and while ambient humidity varies.

The real time auto mapping and auto modeling program ideally is allowed to build and improve the highest order control tables for a time period that is as long as practically possible to obtain the best real time control model. For this modeling embodiment, pipe insulation degradation can also be included as a discontinuous control dimension, as shown in degradation control table 63. Insulation degregation can occur due to the Sun's radiation, humidity contamination, water contamination, insulation compaction, insulation disruption due to service handling, etc. Rapidly changing continuous control effects or drivers that affect all gain corrections populated in control tables 61, 62, and 63 shown in this example can be employed in a PID style and/or other continuous control implementation.

In some embodiments, wind velocity is measured as a control gain input and is shown in FIG. 3 as wind control gain input 64. The feedback for the wind control gain input 64 in this example is wind velocity and its gain is calibrated by its effect on temperature measurement device 66-*n*. In this embodiment, error summation function 73 is used for the final supervisory loop to again invoke real time control over the super-heat system to schedule the desired amount of energy from super-heater 59 to provide a minimum amount of super-heat to keep the steam above saturated conditions (e.g., within a defined temperature and/or energy range of saturated conditions) at the entrance to the farthest pad's super-heater shown in FIG. 3 as super-heater 67-*n*. The use of AES may also create the requirement for a modified super-heat control set point to the system where additional super-heat may be scheduled to allow the AES to contact the bitumen at the optimized temperature to release its latent heat and surfactant, and or solvent under optimized conditions to reduce SOR and OPEX.

In some embodiments, a greater number of control tables and/or degrees of control or fewer number of control tables and/or degrees of control in both continuous and discontinuous corrections (e.g., control strategies) can be used. In some embodiments, a more precise super-heat control can be affected in response to the more degrees of control with the more accurately derived gains mapped and installed. In a preferred embodiment, the real time modeling program, such as MathWorks, can populate an acceptable amount of control tables or control dimensions and the now real time control system can continuously measure the appropriate amount of feedbacks, such as ambient temperature, ambient humidity, and potentially predicted insulation degradation to multiply the correct gains, shown pictorially as line 105 in FIG. 3, which then is modified by continuous control gain functions shown as wind control gain input 64 and error summation function 73 (e.g., control loops). Embodiments of the present disclosure, as described herein, could include other (e.g., more relevant functions) or less continuous or discontinuous control functions (e.g., control strategies), such as but not limited to Feed Forward functions, Cascaded Loop functions, Proportional Gain control functions, Proportional and Integral control functions, Proportional, Integral and Derivative control loop functions.

Parameters that affect the heat transfer and thus the reduction in super-heat along the length of the steam conduit 18 can be monitored and through control tables, equations and/or algorithms are used to predict and thus control the amount of super-heat at the furthest well, the position of which can be associated with temperature measurement device 66-*n*. These control tables, equations and/or algorithms are initially populated by modeled and empirical data and improved by continuous learning by feedback primarily received from temperature measurement device 66-*n* or SOR meters. By using measurements and these controls, the effect of disturbances such as wind change are minimized. Tools for deriving and improving the real-time predictions and controls using empirical data include software and methods from "Mathworks" such as MBC toolbox, MatLab, and/or Simulink.

After the real time model is built, it can be continuously updated and/or improved by the statistically based program if desired and/or can be manually remapped when required. The real time control system can use the populated control tables 61, 62 and 63 and the supervisory loops to implement optimum control of the super-heat generated by super-heater 59. When performing an automated continuous remapping, in quasi steady state conditions, the control tables 61, 62, 63 and wind velocity gain are updated to minimize error associated with the error summation function 73 (e.g., supervisory control loop). The auto mapping goal is to have the modeled gains, when implemented, schedule the correct amount of super-heat without the intervention of an offset by error summation function 73.

Continuing to describe the embodiment in FIG. 1, well pads 26, 42 and 49 can be configured a number of different ways for the continued implementation of super-heat to the sub surface injection piping and wells. At well pad 26, individual super-heaters 32, 33, 34, 35, and 36 can be employed downstream of super-heater manifold 37. Individual SOR meters, such as Schlumberger's VX Spectra, are employed per well and are depicted as SOR meters 21, 22, 23, 24 and 25 deployed upstream of production conduit 20 and downstream of valves 27, 28, 29, 30, 31. In this arrangement, individual well optimization is possible. In some embodiments, at pad 49, one super-heater 47 is employed upstream of manifold 48 and no SOR meter or optional SOR meter 50 are disposed at an associated production conduit.

In a preferred embodiment, well pad 42 has one super-heater (e.g., super-heater 40) and one SOR meter per well (SORs 43, 44, and 45). With this configuration, cost effective individual well optimization is possible. The optimum amount of super-heat for the sub service injection piping is controlled by by-pass piping system shown originating at manifold 39 and terminating at control valves (again one 3 way or 2 one way valves as an example) 100, 101 and 102 and can be further distributed by super-heater manifold 41.

FIG. 4 depicts improved process controls, real time modeling, and real time control systems for site sub surface piping, in accordance with embodiments of the present disclosure. The super-heater 68, shown in FIG. 4, may be controlled in the same fashion as described for the above ground piping system but now using the appropriate control functions, such as temperature and/or energy feedback devices 83 or 91 on the Toe injection pipe 76, 92 and temperature feedback devices 84 or 85 on the Heel injection pipe 86. A preferred embodiment would be to control the amount of super-heat scheduled by super-heater 68 to affect a minimum amount of increased energy in the steam at temperature and/or energy feedback devices 83 and 84 or by temperature and/or energy feedback devices 93 and 91 to reach the desired minimum level of super-heat. Many real time control algorithms could be employed to derive the desired minimum amount of increased energy in the steam.

An example of one preferred control embodiment could be employed to accommodate naturally occurring obstacles to bitumen production, such as shale deposits 88. To schedule optimum levels of super-heat from super-heater 68, the well may have fiber optic temperature feedback measurement systems shown as injector string 77 on the injector pipe and/or fiber optic producer string 82 on the producer conduit 79. Fiber optic temperature measurement strings could also be augmented or replaced by conventional static measurement devices shown as temperature and/or energy feedback devices 83, 93, 91, 84, 85, 98, 96 and 94. Optional steam splitters 87, 89 and 90 and/or optional flow control devices 97 and 95 may be included in the chamber and may be static in function or remotely adjustable.

In a preferred embodiment, super-heat may be controlled and real time modeled by pulsing steam flow through Toe injection pipe 76, 92 to a lower energy level for a defined period of time while temperature feedbacks either from the preferred fiber optic injector string 77 and fiber optic producer string 82 are monitored. Rate of change of temperature in the example of the shale deposit shown in FIG. 4 can naturally show a higher rate of temperature loss directly preceding the shale deposit and downstream of the shale deposit. Reactive temperature measurements on the fiber optic producer string 82 can show the inverse function of higher rate of temperature loss directly across from the shale deposit and slower temperature loss where the shale deposits do not exist. The statistically driven real time modeling function can affect control in a preferred embodiment by closing steam splitter 87, increasing saturated steam flow at Heel location 86, opening flow control device 97 on the fiber optic producer string 82 to increase energy flow around shale deposit 88 and continue to minimize detrimental deviations in ideal consistent chamber formation to most cost effectively extract the maximum amount of bitumen per well.

If adjustable steam splitter 87 does not exist in the first chamber 81, a successful real time control model for this area of the SAGD system could increase super-heat in injection Toe injection pipe 76, 92 to reduce the heat transfer into shale deposit 88 and increase saturated steam injection in Heel injection pipe 86 to again melt around the shale deposit 88 (e.g., shale obstruction).

An infinite amount of real time models and real time control strategies can be implemented from as many control feedbacks, control actuators and degrees of continuous and discontinuous control functions as the practitioner has time and resources to implement.

In some embodiments employing super-heat real time control, the super-heater 68 could be scheduled or increased while monitoring SOR meter 74 disposed on producer conduit 79 near the end of the chamber's useful life to extend the penetration of the steam's heat energy and more efficiently extend the production of the well by increasing the effective size over a conventional saturated steam's reach from first chamber 81 to second chamber 80, located under cap rock 78. As depicted, the second chamber 80 can have a larger chamber size than first chamber 81.

Figure 2:
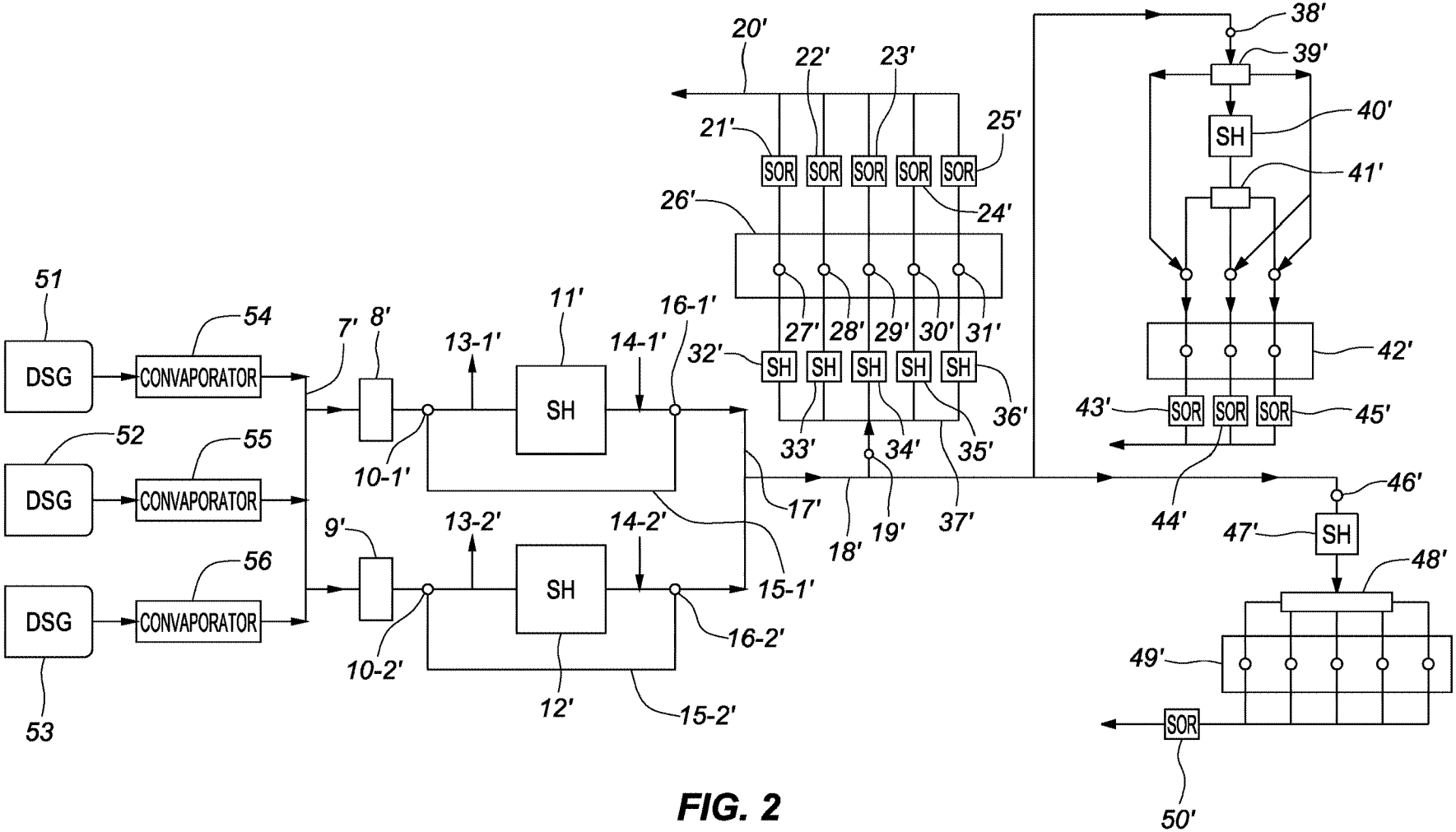
FIG. 2 depicts a system and apparatus for enhanced oil and gas recovery with super focused heat that employs Direct Steam Generator (DSG) boilers, in accordance with embodiments of the present disclosure.

FIG. 2 depicts a system and apparatus for enhanced oil and gas recovery with super focused heat that employs Direct Steam Generator (DSG) boilers, in accordance with embodiments of the present disclosure. FIG. 2 is the same as FIG. 1 with the addition of a more advanced steam generation system employing a DSG, shown as DSGs 51, 52, and 53. Exhaust constituents can be separated from the steam through processes 54, 55, or 56 (e.g., convaporators) and a saturated or super-heated steam can be continued to be processed in the balance of the system in the same fashion as described for FIG. 1. Embodiments of the present disclosure can include one or more convaporators such as those disclosed in U.S. patent publication no. 2016/0348895, which is incorporated by reference as though fully set forth herein. Steam separators 8' and 9' may be augmented depending on the quality of the feed water used in FIG. 2. Applicant has chosen to use the same number, with the addition of a "prime" symbol to identify similar or the same elements in different figures. The elements identified with the addition of a "prime" symbol in FIG. 2 can identify the same or similar elements in FIG. 1. For example, the super-heater 11 depicted in FIG. 1 and the super-heater 11' depicted in FIG. 2 can identify the same or similar element.

The real time modeling and control system described in embodiments of the present disclosure can be used to optimize saturated steam flow and/or super-heated steam flow, or AES in both steam circulation, bitumen production, SAGD, Steam Flood, and/or CSS modes of operation. For example, an outer supervisory loop can be defined as chamber pressure to restrict maximum steam flow and a more inner control loop can be implemented through minimum subcooling between the injector and the producer temperature feedback which is preferably fiber optic string 82 or static sensors 98, 96, 94. Chamber pressure can be monitored via one or more pressure sensors disposed within the chamber (e.g., first chamber 81, second chamber 80).

The real time control system can increase the steam flow (e.g., saturated steam flow, super-heated steam flow, and/or AES in a super-heated steam flow) until the fiber optic feedback sensors 82 or static temperature sensors 98, 96, 94 register a minimum temperature difference from the steam injected into the injector pipe (e.g., Toe injection pipe 76, 92, Heel injection pipe 86). In an example, the real time control system can increase the steam flow until a temperature measured by the fiber optic feedback sensors 82 and/or static temperature sensors 98, 96, 94 is within a defined set point temperature range (e.g., definable by a user) of the steam measured at a point along the Toe injection pipe 76, 92 and/or Heel injection pipe 86. In some embodiments, the defined set point temperature range can be in a range from 0 degrees Celsius to 25 degrees Celsius. However, in some embodiments the defined set point temperature can be in a range from 1 degree Celsius to 15 degrees Celsius. For instance, the steam flow can be increased until a temperature measured by the fiber optic feedback sensors 82 and/or static temperature sensors 98, 96, 94 begins to converge on a temperature of the steam measured at a point along the Toe injection pipe 76, 92 and/or Heel injection pipe 86. The temperature of the steam measured along the Toe injection pipe 76, 92 and/or Heel injection pipe can be statistically measured, for example, via fiber optic injector string 77 and/or temperature and/or energy feedback devices 83, 84, 85, 93, for example, and/or at a location upstream of the feedback devices. In some embodiments, the chosen delta temperature set point can be a statistical average over the length of the chamber in response to chamber obstructions.

The defined set point temperature range (e.g., minimum control set point) can be an outer supervisory loop, but can be second in control priority with respect to the maximum chamber pressure. For example, control of the steam flow can be based first in priority on the maximum chamber pressure and can be based second in priority on the defined set point temperature range.

In some embodiments, the control methods used to compensate for shale deposits 88 can be implemented, as described herein, to map (e.g., via temperature and/or energy feedback devices disposed on or next to the injection pipes and/or producer pipe(s)) and implement a defined (e.g., ideal) continuous (e.g., consistent) temperature profile across the complete chamber (e.g., across fiber optic strings 82 and 77), for example, through control of steam via splitters and/or flow control devices included on the injection pipes and/or producer pipe. This control modification can be implemented through discontinuous control tables, as previously described herein. In some embodiments, the steam splitters can be actuated to normalize the temperature of the complete chamber (e.g., first chamber 81, second chamber 80) after the control system again, as previously discussed, reduces steam flow with or without super-heat for a short defined period of time into first chamber 81 and the automated mapping system monitors and/or maps a resultant rate of temperature change and/or variation in temperature change in fiber optic strings 82 and/or 77. The splitters 87, 89, and/or 90, flow control devices 97, 95, and/or super-heat produced, for example by super-heater 68 can then be automatically adjusted to inject a larger or smaller amount of steam (e.g., energy) into different areas of the chamber (e.g., first chamber 81, second chamber 80) to perfect a desired continuous temperature profile across fiber optic strings 82 and 77.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be further appreciated that for conciseness and clarity, spatial terms such as "vertical," "horizontal," "up," and "down" may be used herein with respect to the illustrated embodiments. However, these terms are not intended to be limiting and absolute.

Although at least one embodiment for a method, apparatus, real time modeling and control system, for steam and steam with super-heat for enhanced oil and gas recovery has been described above with a certain degree of particularity, those skilled in the art could make numerous alterations to the disclosed embodiments without departing from the spirit or scope of this disclosure. Additional aspects of the present disclosure will be apparent upon review of Appendix A. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A system for reducing an operating expense and a steam oil ratio (SOR) of at least one of an enhanced oil recovery system and a gas recovery system comprising:

a boiler configured to produce steam;

a super-heater in fluid communication with the boiler, the super-heater configured to generate a plurality of super-heat levels in a plurality of sections of the at least one of the enhanced oil recovery system and the gas recovery system downstream of the super-heater, wherein the plurality of super-heat levels are implemented per each one of the plurality of downstream sections of the at least one of the enhanced oil recovery system and gas recovery system to reduce the SOR; and a plurality of sensors configured to determine a plurality of environmental conditions external to the system, wherein the plurality of super-heat levels are controlled based on the environmental conditions external to the system.

2. The system of claim 1, wherein a direct steam generator (DSG) is in fluid communication with the super-heater and super-heat is supplied by both the DSG and the super-heater.

3. The system of claim 1, wherein a direct steam generator (DSG) is in communication with at least one super-heater and super-heat is supplied by both the DSG and the at least one super-heater and super-heat is controlled and optimized by the real time control system per section of the at least one of the enhanced oil recovery system and gas recovery system.

4. The system of claim 1, wherein a temperature feedback is used to schedule super-heat steam quality control.

5. The system of claim 1, wherein the super-heater is bypassed and cleaned.

6. The system of claim 5, wherein the super-heater is automatically bypassed and automatically back washed or cleaned on a defined schedule.

7. The system of claim 5, wherein the super-heater is automatically bypassed and automatically back washed or cleaned on a schedule dictated by heat tube temperature or super-heater loss of efficiency.

8. A system for reducing an operating expense and a steam oil ratio (SOR) of at least one of an enhanced oil recovery system and a gas recovery system comprising:

a boiler configured to produce steam;

a super-heater in fluid communication with the boiler, the super-heater configured to generate a plurality of super-heat levels in a plurality of sections of the at least one of the enhanced oil recovery system and the gas recovery system downstream of the super-heater, wherein, a real time control system controls the plurality of super-heat levels per section of the at least one of the enhanced oil recovery system and gas recovery system based on signals received from a plurality of sensors configured to determine a plurality of environmental conditions external to the system.

9. The system of claim 8, further comprising a plurality of super-heaters fluidly coupled in series with one another to optimize super-heat control by the real time control system per section of the at least one of the enhanced oil recovery system and gas recovery system.

10. A system for reducing an operating expense and steam oil ratio (SOR) of at least one of an enhanced oil recovery system and gas recovery system comprising:

at least one boiler in fluid communication with a plurality of wells included in a plurality of sections of the at least one of the enhanced oil recovery system and gas recovery system, wherein the boiler is configured to produce steam, and wherein a real time control system controls steam flow levels with or without super-heat to each one of the plurality of wells of the at least one of the enhanced oil recovery system and gas recovery system using a temperature feedback, at least one of discontinuous and continuous control tables, and supervisory loops to invoke optimum steam flow conditions, wherein the control tables account for at least one of an ambient temperature and a humidity of an environment in which the system is disposed.

11. The system of claim 10, wherein a program maps and populates the control tables.

12. The system of claim 10, wherein a statistically based program maps and populates continuous and discontinuous control functions for controlling steam flow.

13. The system of claim 10, wherein a statistically based program continuously maps and populates continuous and discontinuous control tables and functions for controlling steam flow while a real time control system is also active for controlling steam flow.

14. The system of claim 13, wherein the functions for controlling steam flow are derived in real time and a real time control system uses the results of the real time derived functions to schedule an optimum amount of super-heat.

15. The system of claim 14, wherein a plurality of super-heaters are in fluid communication with each other and the boiler, and wherein the plurality of super-heaters are configured to optimize super-heat control by the real time control system per section of the at least one of the enhanced oil recovery system and gas recovery system.

16. The system of claim 10, wherein the super-heat is optimized per pad associated with each well.

17. The system of claim 10, wherein the super-heat is optimized per well.

18. The system of claim 10, wherein a heavy hydrocarbon viscosity reducer selected from the group consisting of light hydrocarbons, solvents, and surfactants is injected into the steam flow.

19. The system of claim 10, wherein a heavy hydrocarbon viscosity reducer selected from the group consisting of light hydrocarbons, solvents, and surfactants is injected into the steam flow and super-heated.

20. The system of claim 10, wherein:

a heavy hydrocarbon viscosity reducer selected from the group consisting of light hydrocarbons, solvents, and surfactants is injected into the steam flow and super-heated, and the heavy hydrocarbon viscosity reducer is formulated to condense or activate within a defined range of the saturation steam temperature.

21. The system of claim 10, wherein additional superheaters are added to extend a distance at which high quality steam can be piped to remote well pads.

* * * * *